US005564481A

United States Patent [19]

Clüsserath

[11] Patent Number: 5,564,481

[45] Date of Patent: Oct. 15, 1996

[54] FILLING ELEMENT FOR FILLING MACHINES FOR DISPENSING A LIQUID FILLING MATERIAL INTO CONTAINERS

[75] Inventor: Ludwig Clüsserath, Bad Kreuznach, Germany

[73] Assignee: KHS Maschinen- und Analagenbau Aktiengesellschaft, Bad Kreuznach, Germany

[21] Appl. No.: 209,291

[22] Filed: Mar. 10, 1994

[30] Foreign Application Priority Data

Mar. 10, 1993 [DE] Germany ..... 43 07 521.5

[51] Int. Cl.[6] ..... B65B 1/04; B65B 3/04

[52] U.S. Cl. ..... 141/92; 141/39; 141/48

[58] Field of Search ..... 141/39, 40, 48, 141/51, 95, 92, 90, 91, 267, 63, 146, 147, 144, 374

[56] References Cited

U.S. PATENT DOCUMENTS

| | | | |
|---|---|---|---|
| 2,605,949 | 8/1952 | Stern | 141/39 |
| 2,896,674 | 7/1959 | Day et al. | 141/39 |
| 3,531,908 | 10/1970 | Raising et al. | 141/92 X |
| 3,799,219 | 3/1974 | Uth et al. | 141/39 |
| 4,086,973 | 5/1978 | Fernandez | 141/39 |
| 4,386,635 | 6/1983 | Ablers | 141/6 |
| 4,982,768 | 1/1991 | Ahlers | 141/6 |
| 5,000,234 | 3/1991 | Weiss | 141/6 |
| 5,037,673 | 7/1991 | Clusserath | 141/6 |
| 5,163,487 | 11/1992 | Clüsserath . | |
| 5,167,266 | 12/1992 | Diehl et al. | 141/92 X |
| 5,329,963 | 7/1994 | Jones et al. | 141/6 |

FOREIGN PATENT DOCUMENTS

| | | | |
|---|---|---|---|
| 700191 | 12/1940 | Germany | 141/39 |

*Primary Examiner*—Henry J. Recla
*Assistant Examiner*—Steven O. Douglas
*Attorney, Agent, or Firm*—Robert W. Becker & Associates

[57] ABSTRACT

A filling element for dispensing a liquid filling material into bottles or similar containers. The filling element has no filling tube or at most a short filling tube. For treating a respective container with a sterilization medium, preferably with steam, a sterilization tube is provided that can be moved out of an upper lifting or stroke position into a lower lifting or stroke position in which at least one opening formed in a lower end portion of the sterilization tube is disposed in the container in such a way that especially also the base portion of the container that is disposed opposite a mouth region thereof is adequately subjected to the sterilization medium that is discharged into the interior of the container from the tube opening or is withdrawn from the interior of the container through the tube opening and the tube.

24 Claims, 5 Drawing Sheets

FILLING ELEMENT FOR FILLING MACHINES FOR DISPENSING A LIQUID FILLING MATERIAL INTO CONTAINERS

BACKGROUND OF THE INVENTION

The present invention relates to a filling element for filling machines for dispensing a liquid filling material into bottles or similar containers. The filling element has a liquid channel that is provided with a liquid flow valve and that forms a discharge opening via which, during a filling phase with the liquid flow valve open, the liquid filling material flows into a container that has been placed against the filling element.

Numerous types of filling elements are known, including the embodiment of U.S. Pat. No. 5,163,487, Clusserath. This filling element is suitable, for example, with a method or a filling machine for the aseptic or sterile dispensing of a liquid material into containers, especially bottles. This known filling element is provided with a filling tube that projects beyond the underside of the filling element. The actual filling phase, which is initiated with the opening of the liquid flow valve, is preceded by, among other things, the treatment or sterilization of the respective container with a hot sterilization medium, preferably steam. For this purpose, the filling tube, via a controllable sterilization medium connection that is formed in the filling element, is connected to a source for the hot sterilization medium, so that this medium discharges at the bottom end of the filling tube that projects into the container. It is critical for the quality of the sterilization that the end of the filling tube, i.e. the discharge location for the sterilization medium, which discharge location is determined by the end of the filling tube during the sterilization process, be disposed deep enough in the container, at a slight distance from the base of the container, that the base of the container is adequately subjected to the sterilization medium and an intensive flow of the sterilization medium results, for example in an outward direction along the base of the container radially relative to the container axis or to the axis of the filling element or of the filling tube, and then axially upwardly from the base of the container, especially along the inner surface of the periphery of the container, as a result of which an optimum sterilization of the interior of the container, even in the lower region, i.e. especially along the inner surface of the base, and also of the periphery of the container and in the angular portion formed between these two regions.

One of the drawbacks of this known filling element is that for the introduction of the filling tube into the container, which filling tube is as long as possible for an optimum sterilization, a relatively great lift or stroke is necessary for the container that is disposed on a container carrier until the container rests against the filling element in a sealing manner (the sealing position). Thus, a relative long cycle time is necessary until the container has achieved the sealing position and it is possible to subject the interior of the container with the pressure of the hot sterilization medium, as is necessary in many cases in order to achieve an optimum sterilization result.

It is an object of the present invention to provide a filling element with which an optimum sterilization can be achieved despite short strokes and despite the possibility of shortening the cycle times.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
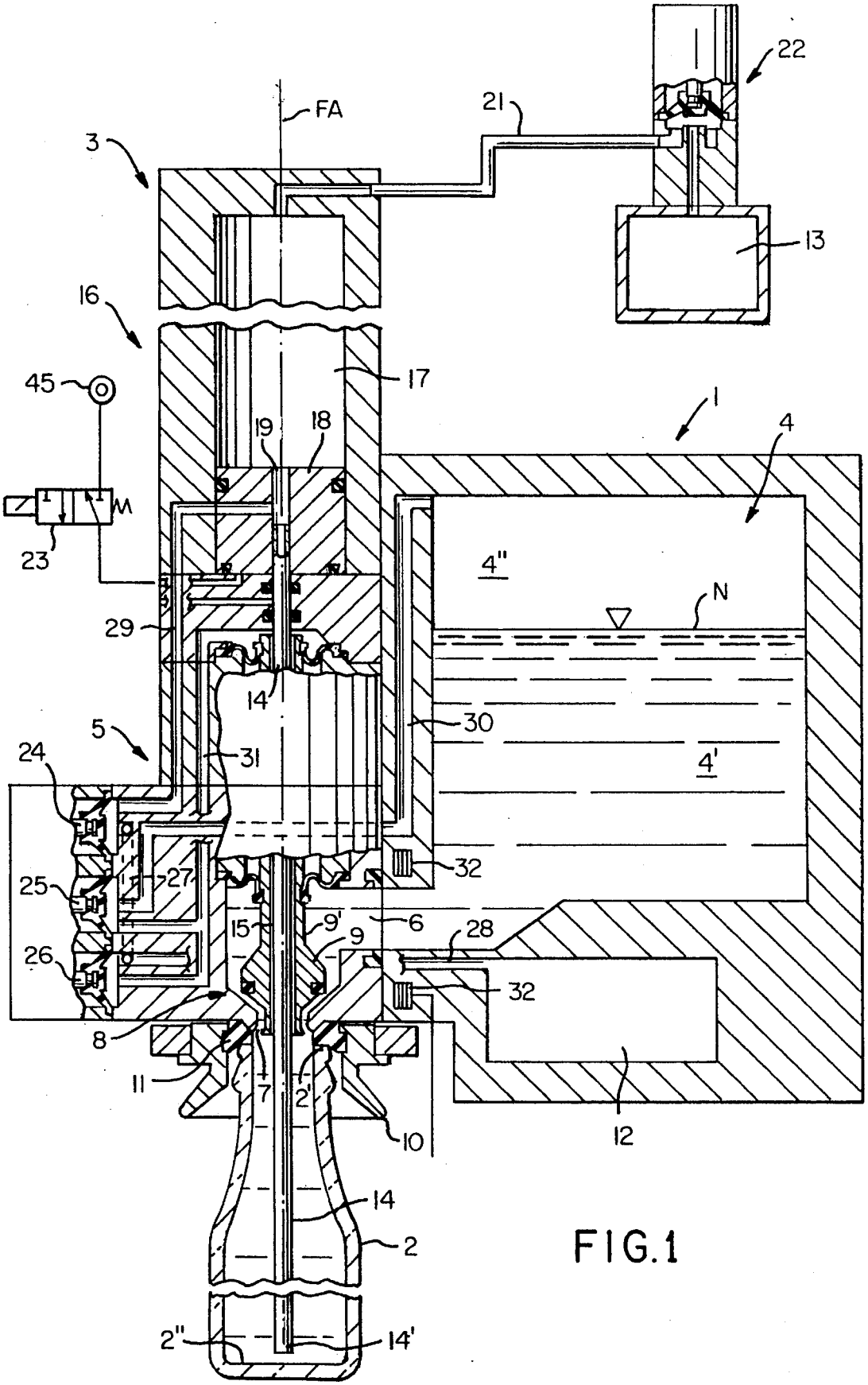
FIG. 1 is a simplified cross-sectional view of one exemplary embodiment of the inventive filling element, which has no filling tube and is intended for a rotating-type counter pressure bottle filling machine, with FIG. 1 also showing the annular tank of the filling machine and a bottle that has been placed against the filling element.

The filling element of the present invention comprises a sterilization tube; a control means for moving the sterilization tube, in the direction of the axis of the filling element, between a lower lifting or stroke position, in which a give length of the sterilization tube extends beyond the underside of the filling element and into the container that has been placed thereagainst, and an upper lifting or stroke position, in which at least a portion of the given length of the sterilization tube is retracted into the filling element, with the filling element having no filling tube or at most a short filling tube; a source for a sterilization medium, preferably steam; connecting means for connecting the source for a sterilization medium to the filling element; and a first control device for effecting connection of the connecting means between the source for a sterilization medium and the filling element such that in a sterilization phase, sterilization medium flows through the sterilization tube and treats the interior of the container, wherein a lower end portion of the given length of the sterilization tube is provided with an opening that during the sterilization phase is disposed so deeply within the container that the sterilization medium is also supplied to a base region of the container that is disposed opposite a mouth region thereof.

As indicated above, the inventive filling element has no filling tube or at most a short filling tube, so that to place the respective container against or withdraw it from the filling element, a short stroke and hence also a short cycle time are adequate.

During or after placement of the respective container against the filling element, when a treatment of the container with the sterilization medium is provided, the sterilization tube is then moved out of its upper lifting or stroke position into its lower stroke position in which the lower end portion of this tube, which is provided with at least one discharge opening, extends deeply into the container, and in particular with the least possible spacing relative to the base of the container, so that an optimum sterilization of the entire interior of the container is possible with a minimum quantity of sterilization medium and in a short treatment cycle. The sterilization tube and the parts connected therewith, especially the control means provided for the movement of the tube, can have a small mass. Therefore, no great mass accelerations are necessary, which is of great significance especially with filling machines that operate at a high efficiency.

By means of the control elements that control the respective filling element, in particular also the sterilization tube and the pertaining control means are controlled in such a way that at least during the filling phase, an preferably also during a pressurizing phase that might precede this filling phase and in which the interior of the container, which is in a sealing position relative to the filling element, is pressurized to a prescribed pressure, the sterilization tube is disposed in the upper stroke position such that if a possibly defective container bursts or breaks, this tube will not be damaged, and in particular is also protected from having liquid filling material deposit on the tube; this also contributes to an increase in the quality of the sterilization.

Pursuant to one preferred specific embodiment of the present invention, the control means is embodied in such a way that the sterilization tube is moved and held in the lower stroke position by the pressure of the sterilization medium. In this way not only is a simplification of the control means and the pertaining control achieved, but in addition there is also ensured that the sterilization tube will be in the lower stroke position when hot sterilization medium is discharged therefrom.

During the sterilization, the sterilization medium discharges from the lower end of the sterilization tube. However, embodiments are also conceivable where the sterilization medium that is supplied to the container, for example via a gas channel, is withdrawn from the container via the lower end of the sterilization tube, whereby in this case it is then, for example, also possible to withdraw condensate or residual condensate that might form with the sterilization medium via the sterilization tube.

Furthermore, with the present invention it is also possible to connect the sterilization tube to a source for a partial vacuum in order in this manner to evacuate the container via the sterilization tube, and preferably also to remove liquid or condensate. Finally, with the present invention it is also possible to provide such a control that already in the upper stroke position hot sterilization medium discharges from the sterilization tube, whereby especially prior to the placement of a container against a filling element it is possible to treat with the sterilization medium those parts that come into contact with the container in the region of the mouth thereof. With the present invention the sterilization tube is also introduced into the respective container to such an extent that the base of the container is adequately subjected to the sterilization medium.

Further specific features of the present invention will be described in detail subsequently.

Description of Preferred Embodiments

Referring now to the drawings in detail, an annular tank 1, is shown that is provided on an otherwise not illustrated filling machine rotor that rotates about a vertical machine axis. The annular tank 1 serves for filling the bottles 2 with a carbonated beverage, such as beer.

Formed at the periphery of the rotor, i.e. of the annular tank 1 are a number of filling stations, each of which has a filling element 3 and therebelow a bottle carrier that can be moved up and down in a vertical direction. The filling elements 3 are secured to the periphery of the annular tank 1. The annular tank forms an inner chamber 4 that surrounds the vertical machine axis in a ring-like manner and that is filled to a prescribed level N with the beverage or liquid filling material, so that below the level N a liquid chamber 4' that is occupied by the liquid filling material is formed, while above the level N a gas chamber 4" is formed for a pressurized gas, for example an inert gas (e.g. $CO_2$ gas).

Each filling element has a housing 5, in the lower portion of which is formed a liquid channel 6, one end of which communicates with the filling material chamber 4', while at the underside of the filling element 3, i.e., of the housing 5, the liquid channel 6 forms an annular discharge opening 7 that concentrically surrounds the vertical filling element axis FA. The liquid flow valve 8 is provided in the liquid channel 6; in FIG. 1, the liquid flow valve 8 is shown in its open position. The liquid flow valve comprises a valve body 9 that, by actuating means that are not illustrated in detail, can be moved in the direction of the axis FA by a prescribed movement stroke for opening and closing. In the closed state of the liquid flow valve 8, a surface of the valve body 9 rests against a valve seat formed in the liquid channel 6. Also shown are a centering tulip 10 and an annular sealing means 11 that surrounds the discharge opening 7 and against which the mouth 2' of the bottle 2 is pressed when the bottle is in a sealing position relative to the filling element 3.

Provided in the annular tank 1 below the inner chamber 4 is an annular residual gas channel 12 that is common to all of the filling elements 3. Also provided on the annular tank 1, or on the rotor that is provided with this annular tank, is a supply channel 13 for the sterilization medium, namely steam; this supply channel 13 is again common to all of the filling elements 3.

Each filling element 3 has a sterilization tube 14 that is coaxial with the axis FA. The bottom end 14' of the tube is open, and the tube extends through a bore of the valve body 9 that extends coaxial to the axis FA. The outer diameter of the sterilization tube 14 and the inner diameter of the bore of the valve body 9 are coordinated with one another in such a way that a gas or annular channel 15 results within the valve body 9, i.e. within a stem or plunger-like extension 9' that is integrally formed with the valve body and extends upwardly. The annular channel 15 is open at the underside of the filling element 3 and is concentrically surrounded by the annular discharge opening 7. By means of an actuating or control means 16 provided on the upper side of the filling element 3, the sterilization tube 14 can be displaced in the direction of the axis FA by a prescribed stroke in such a way that in the upper stroke position the end 14' of the tube is disposed at the same level or nearly the same level as the lower end of the valve body 9, in other words, is retracted into the filling element 3, i.e., into the valve body 9; in the lower stroke position illustrated in FIG. 1, the end 14' of the tube is introduced into the bottle 2 that rests against the filling element 3 to such an extent that the end 14' of the tube is disposed in the immediate vicinity of the inner surface of the base 2" of the bottle 2, or at least is spaced from the base only to such an extent that the base is also adequately supplied with steam.

The control means 16 is formed by a cylinder 17 in which is provided a piston 18 that can be displaced in the direction of the axis FA. The upper, open end of the sterilization tube 14 is secured to the piston 18. A channel 19 that extends coaxially with the axis FA is provided in the piston 18. By means of this channel 19, the upper, open end of the sterilization tube 14 communicates with that side of the piston 18 that is remote from this tube.

A channel 21 opens above the piston 18 into that chamber of the cylinder 17 that is remote from the sterilization tube 14. Each filling element 3 has a separate electrical control valve 22 that is individually controllable and via which the channel 21 is connected to the supply channel 13.

By means of an electrically actuatable control valve 23 that is again separately provided for each filling element 3, that portion or chamber of the cylinder 17 that is provided below the piston 18 can, in a controlled manner, be supplied with a pneumatic pressure from a control pressure line 45 or can be vented to the atmosphere.

Each filling element 3 is furthermore provided with three individually controllable control valves 24–26 that form a control unit and control various channels that are formed partially in the housing 5 of the filling element and partially in the annular tank 1. The control valves 24–26 are connected to various channels in the following manner:

Control valve 24

The inlet side is connected to a connecting channel 27 that opens into a channel 28 that leads to the residual gas channel 12, and the outlet side is connected to a channel 29 that opens out on the inner surface of the cylinder 17 and, when the piston 18 or the sterilization tube 14 are disposed in the lower stroke position, communicates with the channel 19.

Control valve 25

The inlet side is connected to a channel 30 that leads to the gas chamber 4", and the outlet side is connected to the gas channel 15.

Control valve 26

The inlet side is connected to the channel 31, and the outlet side is connected to the channel 28.

The special feature of the filling element 3 is that when the sterilization tube 14 is in its upper stroke position, where control pressure is supplied to the underside of the piston 18 via the control valve 23, then by opening the control valve 22 steam can discharge at the end 14' of the tube and hence at the underside of the filling element 3 in order to sterilize parts and surfaces that are located there as well as the bottle 2 when the region of the mouth 2' thereof is placed against the filling element.

After the bottle 2 has been placed against the filling element 3, the sterilization tube 14 is completely introduced into the bottle, so that the end 14' of the tube is disposed in the immediate vicinity of the inner surface of the base 2". The pressure of the sterilization medium or steam is utilized for introducing the sterilization tube 14 into the bottle 2, with this pressure acting upon the upper surface of the piston 18 when the control valve 22 is opened; an appropriate or controlled venting of the chamber of the cylinder 17 that is formed below the piston 18 is effected via the control valve 23. The cross-sectional area of the piston 18 relative to the cross-sectional area of the sterilization tube 14 ensures that the sterilization medium exerts a great enough pressure upon the upper side of the piston 18 although this sterilization medium continuously discharges at the lower end 14' of the tube.

Since the end 14' of the tube is disposed immediately above the inner surface of the base 2", a stream of steam results in the bottle 2 that passes from the end 14' of the tube radially outwardly along the base 2" and then axially upwardly, so that all of the regions of the inner surface of the bottle are intensively treated with the sterilization medium or steam, which at least during a portion of a sterilization phase is withdrawn via the annular channel 15 into the residual gas channel and to the atmosphere.

A further fundamental advantage is that by means of the retractable sterilization tube 14, despite an optimum sterilization only a small stroke is needed for the bottle carrier, and furthermore the sterilization tube 14 is protected in the retracted state especially when the bottle is entering or leaving the filling machine, but also during the critical phases of the filling process, for example during pressurization of the bottle 2 to the filling pressure. As will now be explained in detail, the filling element 3 enables the following operations:

1. Loading of the valve outer parts

As the filling element 3 passes through the phase angle formed between the bottle outlet and the bottle inlet of the filling machine, by opening the respective control valve 22 with the sterilization tube 14 in the upper stroke position steam is discharged at the lower end 14' of the tube. In so doing, the lower cylinder chamber of the cylinder 17 is supplied with the control pressure.

2. Displacement of the air out of the bottle via steam

Immediately after the bottle 2 is pressed against the filling element 3, by again opening the control valve 22 a full stream of steam is introduced into the upper part of the cylinder 17. At the same time, the lower partial chamber of the cylinder 17 is vented via the control valve 23, so that the sterilization tube 14 is moved downwardly out of the upper stroke position and is introduced increasingly deeper into the bottle 2. By means of the steam that exits the end 14' of the tube, the air in the bottle 2, which is disposed in a sealing position against the filling element 3, is increasingly displaced out of the bottle and is withdrawn via the annular channel 15 and opened control valve 26 to the residual gas channel 12, which is, for example, at atmospheric pressure. An optimum sterilization of the inner surfaces of the bottle 2 is effected by the stream of steam. The sterilization tube 14 is also included in this sterilization, with both the inside and the outside of the tube being sterilized by the steam.

3. Sterilization of the bottle 2 and the filling element 3 under overpressure After the air has been completely displaced out of the bottle 2, the control valve 26 is closed so that with the control valve 22 still open and via the sterilization tube 14, steam is introduced into the bottle 2 until a pressure equalization with the pressure in the supply channel 13 is achieved.

4. Displacing steam with inert gas $CO_2$

After the conclusion of a prescribed sterilization time, the control valve 22 is closed. At the same time, with the control valve 26 again opened, the steam overpressure is withdrawn into the residual gas channel 12. Immediately thereafter, the control valves 24 and 25 are opened so that via the channels 30 and 31 as well as via the annular channel 15, inert gas passes out of the gas chamber 4" into the bottle 2, thereby displacing the residual steam to the residual gas channel 12 via the sterilization tube 14, the channel 29, the connecting channel 27, and the channel 28. Since the end 14' of the tube is provided in the immediate vicinity of the inner surface of the base 2", the aforementioned displacement can also remove condensate residue from the bottle 2.

5. Pressurization of the bottle 2

For this pressurization, the valve 24 is closed so that the pressurization can be effected via the opened valve 25 and the channels 30 and 31. For the pressurization of the bottle 2, the sterilization tube 14 is moved into its upper stroke position by appropriate operation of the control valve 23, so that the tube 14 is retracted completely into the filling element 3 and hence is also protected from fragments of glass bottles that might burst.

Subsequent to the aforementioned steps, there is then effected, for example in the conventional process steps, the filling of the bottle 2 (by opening the liquid flow valve 8 and also venting and withdrawing the filled bottle). In this connection, the filling preferably includes a number of phases, and in particular a slow filling phase, a rapid filling phase, and a subsequent slow filling phase.

During the filling, the sterilization tube 14 is again disposed in the upper stroke position. Since the filling element 3 thus has no elements that during the filling extend into the interior of the bottle 2 and could be used as the member or probe that determines the filling height, there is provided for each filling element 3 a magnetic inductive flowmeter 32 (MIF) that delivers to a control means a signal that corresponds to the flow volume, i.e. to the volume that flows to the respective bottle 2 when the liquid flow valve 8 is opened; when the measured quantity or volume corresponds to a prescribed value, the control means delivers a signal that effects closing of the liquid flow valve 8.

In the described embodiment of the control means 16, it is possible to embody the sterilization tube 14 in such a way that in its lower stroke position, the lower end 14' of the tube rests upon the bottle base 2", and in particular in such a way that at the same time steam can discharge. For this purpose, the end 14' of the sterilization tube 14, or the rim thereof, is provided, for example, with indentations or recesses in such a way that as a result thereof projections are formed at the lower end of the tube with recesses being formed between these projections that are open toward the inside of the tube, the outside of the tube, and the underside of the tube. Thus, if when in the lower stroke position the end 14' of the sterilization tube 14 rests upon the base 2" of the bottle 2, independent of tolerances of the bottles 2 essentially the same conditions can always be achieved when treating these bottles.

Changes and modifications of the aforementioned method of operation are possible. For example, it is possible via the steam that is introduced via the sterilization tube 14 to displace out of the respective bottle 2 merely the air without subsequently also supplying to the bottle 2 the steam pressure of the supply channel 13.

The cleaning in place (CIP) cleaning of the filling elements 3 is preferably carried out such that the upper partial chamber of the cylinder 17 above the piston 18 is supplied with pressurized CIP media, and in particular with the lower cylinder chamber being vented via the control valve 23. In this way, the sterilization tube 14 is moved into the lower stroke position, with its entire length extending into the rinsing sleeve that is placed upon the filling element during the CIP cleaning, so that the inside and outside of the entire length of the sterilization tube 14 can be included in the CIP cleaning.

Figure 2:
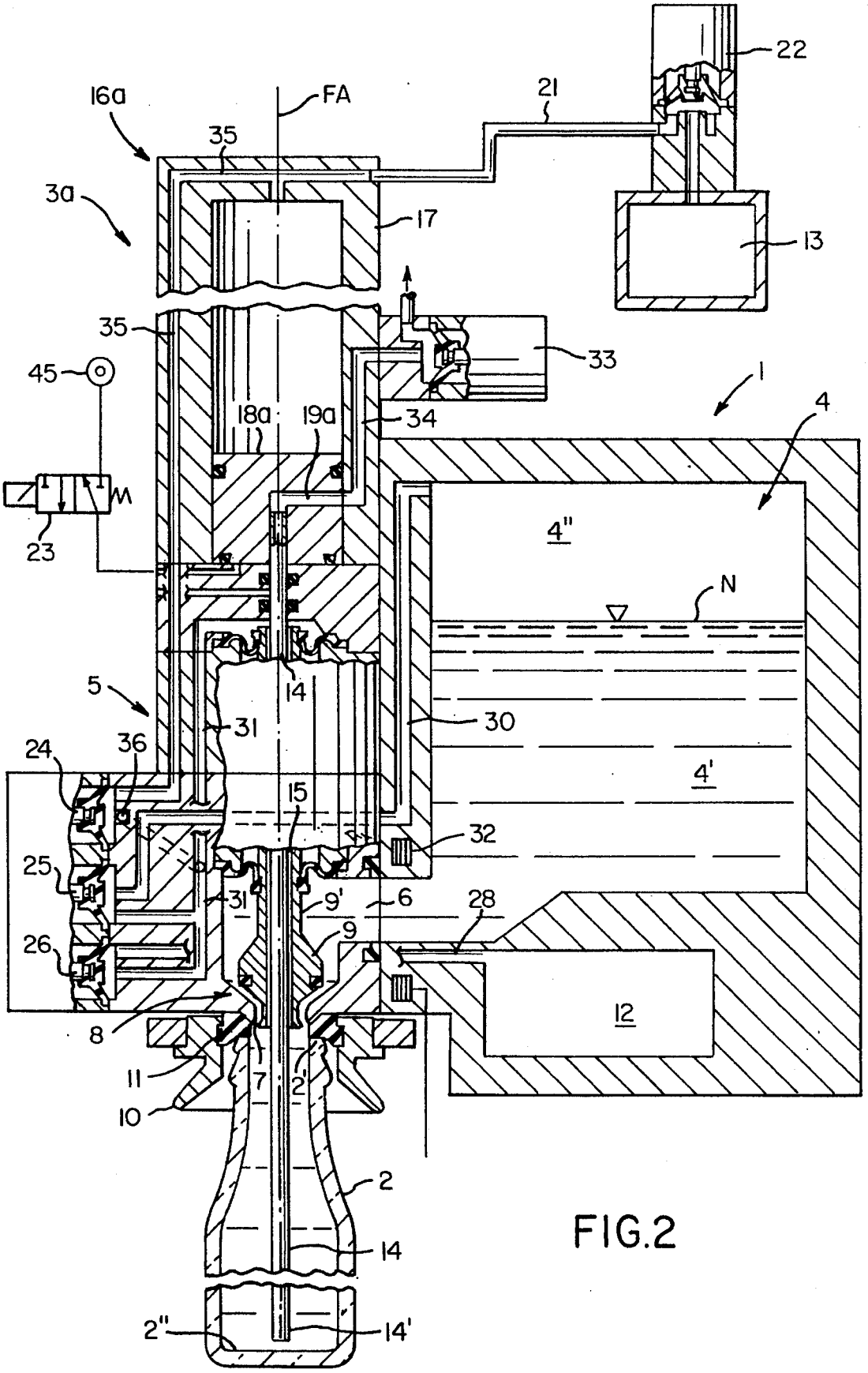
FIGS. 2–4 are views similar to that of FIG. 1 showing further possible exemplary embodiments of the inventive filling element.

FIG. 2 shows a filling element **3*a* that differs from the filling element 3 essentially only by the subsequently to be addressed features, but otherwise corresponds to the filling element 3, so that all elements in the embodiment of FIG. 2 that correspond to the filling element 3 will have the same reference numerals as did the embodiment of FIG. 1, with this also being true for the filling elements 3*b* and 3*c* of FIGS. 3 and 4** that will be described subsequently.

The filling element **3*a* initially differs from the filling element 3 in that the control means 16*a*, instead of the piston 18, has a piston 18*a* with a channel 19*a* that communicates with the upper end of the sterilization tube 14 and is open merely at the peripheral surface of the piston 18*a*, and in particular in such a way that in the lower stroke position of the sterilization tube 14, the channel 19*a* communicates with a channel 34 that is formed in the cylinder 17 and leads to a further control valve 33**.

In addition, with the filling element **3*a*, instead of the channel 29 a channel 35 is provided that connects the outlet side of the valve 24 to the channel 21**.

Finally, instead of the connecting channel 27, a connecting channel 36 is provided that connects the inlet side of the valve 24 to the channel 31.

An essential difference of the operation of the filling element **3*a* relative to the filling element 3 is that for the steam treatment, with the control valves 22, 24 and 33 open, it is possible to provide a stream of steam out of the supply channel 13 and over the annular channel 15 into the bottle 2 and out of this bottle back through the sterilization tube 14, which is in its lower stroke position, and through the channels 19*a* and 34 and the control valve 33 for example into the residual gas channel 12** or into an additional collection channel.

Figure 3:
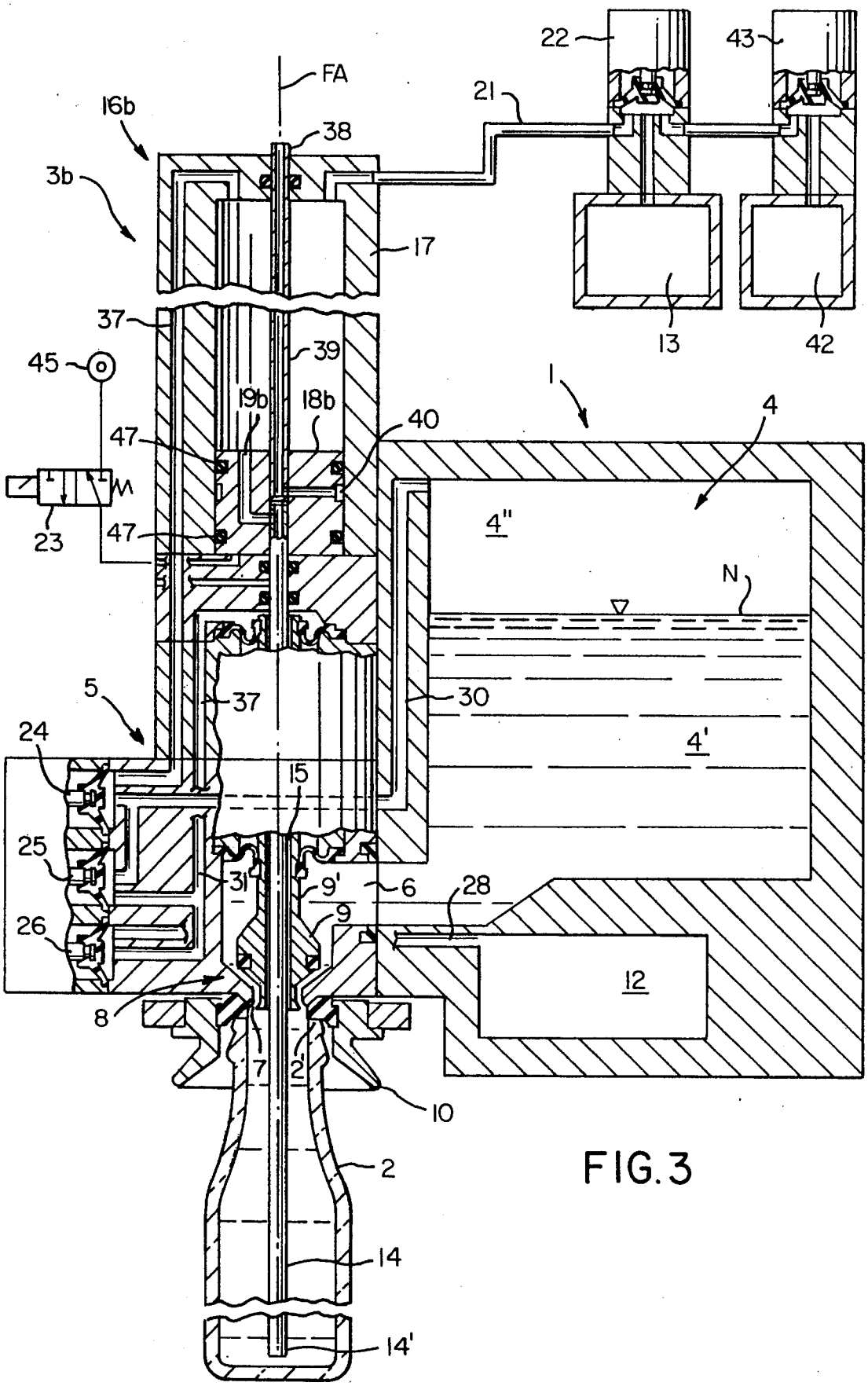

FIG. 3 shows the filling element **3*b* and differs from the filling element 3** essentially by the following features:

The piston **18*b* of the control means 16*b* has a channel 19*b* that again opens into the sterilization tube 14, and is open at the upper side of the piston 18*b*, being offset radially to the axis FA. Instead of the channel 29, a channel 37 is provided that is connected to the outlet side of the control valve 24 and at the upper end of the cylinder 17 opens out into the upper cylinder chamber. With the filling element 3*b*, the connecting channel 27 is eliminated and the inlet side of the control valve 24 is also connected to the channel 30. Furthermore, with the control valve 3*b* an upwardly projecting rod 38 is provided on the piston and is guided to the upper side of the cylinder 17, thus also forming an additional guide means for the sterilization tube 14. The rod 38 has an axially extending channel 39 that is open at the upper side of the rod and communicates with an annular channel 40 that is provided at the periphery of the piston 18*b* between an upper and a lower seal 41. Residual compressed air or steam can be withdrawn via the channels 40 and 39**.

Finally, the embodiment illustrated in FIG. 3 is provided with a vacuum channel 42 that is common to all of the filling elements **3*b*. By means of the channel 21, each filling element 3*b* is connected to the vacuum channel 42 via a control valve 43**.

By means of the additional connection to the vacuum channel 42, it is possible to provide a vacuum treatment of the bottle 2. Furthermore, with the filling element **3*b* a rinsing of the bottle 2 via the sterilization tube 14 is possible, whereby the tube is moved and held in the lower stroke position by the pressure of the inert gas or $CO_2$ that is used for the rinsing and that is supplied to the upper chamber of the cylinder 17 from the gas chamber 4' via the opened control valve 24 and the channel 37**.

Figure 4:
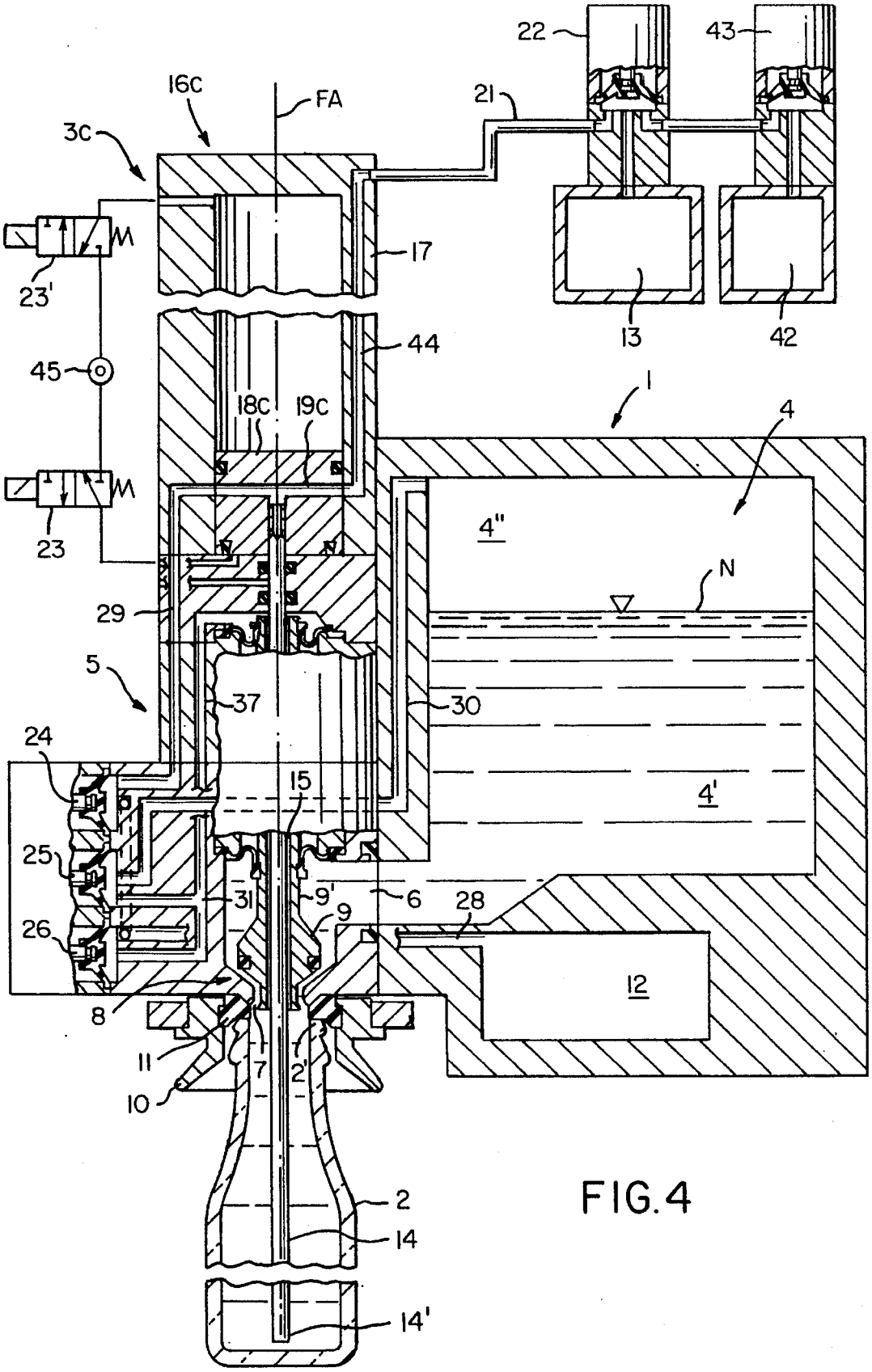

FIG. 4 shows a further possible exemplary embodiment of a filling element **3*c* that differs from the filling element 3 essentially only in that in addition to the supply channel 13 for steam, a vacuum channel 42 is also provided so that by appropriate control of the control valves 22 and 43, the channel 21 can selectively be switched to the supply channel 13 or to the vacuum channel 42**.

With the filling element **3*c*, the channel 21 does not open out into the upper chamber of the cylinder 17, but rather into a channel 44 that is formed in the cylinder and that when the sterilization tube 14 or the piston 18*c* of the control means 16*c* is disposed in the lower stroke position, opens out into the channel 19*c* that is provided in the piston 18*c* and that is in constant communication with the sterilization tube 14 and, in the lower stroke position, also with the channel 29. In addition to the control valve 23, the control valve 23' is provided, both of which are connected to the control pressure or compressed air line 45; the control valve 23' controls the upper chamber of the cylinder 17 while the control valve 23 continues to control the lower chamber of the cylinder 17. Thus, with the filling element 3*c* the stroke of the sterilization tube 14 in both directions is effected by the control pressure medium (compressed air). In this way, the cylinder chambers of the control means 16*c* are kept completely free of those media that also pass into the respective bottle 2 or serve to treat such a bottle, although of course the additional control valve 23'** must be provided.

With the filling element **3*c*, the methods of operation previously described in conjunction with the filling element 3 are possible, and in addition, however, in particular when using the vacuum in the vacuum channel 42, a suctioning off of condensate via the sterilization tube 14 is possible. For this purpose, the sterilization tube 14 is in the lower stroke position, i.e. by means of the control valve 23' the upper chamber of the cylinder 17 is supplied with the control pressure and the lower chamber of the cylinder is vented via the control valve 23. The withdrawal of the condensate is effected by closing the control valves 22, 24, 25 and 26 and opening the control valves 43**.

The invention has been described in conjunction with specific embodiments. It is to be understood that numerous variations and modifications are possible without thereby deviating from the inventive concept. Thus, in principle, it is also possible to move the sterilization tube 14 in the axis FA by a different actuating or control means, for example by a cam, with the control device then preferably being embodied in such a way that a movement in only one direction is produced by the cam, while the movement in the other direction is effected by spring means or by a pneumatic cylinder or the like that acts as a spring, with this other direction preferably corresponding to the upward movement.

Figure 5:
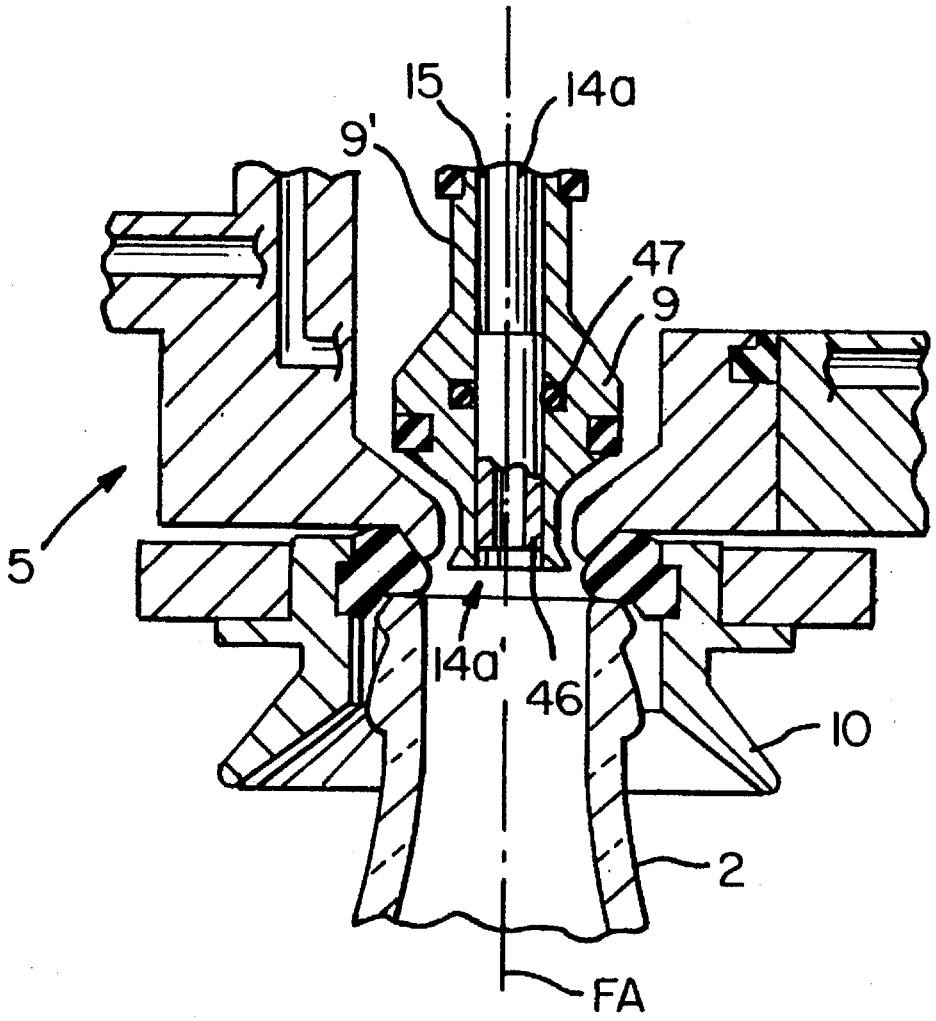
FIG. 5 is a detailed view of the lower end of a sterilization tube, together with a valve body.

As a further exemplary embodiment, FIG. 5 shows a sterilization tube 14*a*, the lower end 14*a*' of which is provided with a head or valve body 46 that cooperates with a valve seat that is formed, for example, from an O-ring 47 and that is provided on the valve body 9 in the vicinity of the lower, open end of the annular channel 15. In the upper stroke position of the sterilization tube 14*a*, the valve body 46 rests against the O-ring and thereby closes off the annular channel 15. Thus, the sterilization tube 14*a* also serves the function of a control valve. In this way, the control valve 26 of the filling elements 3, 3*a*, 3*b* and 3*c* can be eliminated, with the channel 28 then communicating directly with the channel 31.

With the filling element 3*b* of FIG. 3, the rod 38 is preferably integrally formed with the sterilization tube 14 from a single length of a tubular profiled member, with the inner chamber thereof being closed off in the vicinity of the piston 18*b* so that the sterilization tube 14 and the channel 39 that is separate therefrom result.

As a modification of the previously described embodiments, in place of the flowmeter 32 other elements for determining the filling quantity or the filling height can also be used. For example, light or ultrasonic sensors can be used that sense the level of the liquid filling material in the container via a return gas path or the sterilization tube. Furthermore, the sterilization tube can be embodied as the element that determines the filling height, and in particular preferably with a light or ultrasonic sensor. Finally, weighing devices could be provided for the bottles 2, which are, for example, glass or plastic bottles.

With an appropriate configuration, the inventive filling element can also be used for filling cans.

The present invention is, of course, in no way restricted to the specific disclosure of the specification and drawings, but also encompasses any modifications within the scope of the appended claims.

What is claimed is:

1. A filling element for filling machines for dispensing a liquid filling material into containers placed against said filling element, said filling element having a liquid channel that is provided with a liquid flow valve and that forms a discharge opening via which, during a filling phase, said liquid filling material flows into a container that has been placed against said filling element, said filling element further comprising:

a sterilization tube;

a control means for moving said sterilization tube, in the direction of an axis of said filling element, between a lower stroke position, in which a given length of said sterilization tube extends beyond an underside of said filling element and into said container that has been placed against said filling element, and an upper stroke position, in which at least a portion of said given length of said sterilization tube is retracted into said filling element;

a source for sterilization medium;

connecting means for connecting said source for a sterilization medium to said filling element; and a first control device for effecting connection of said connecting means between said source for a sterilization medium and said filling element such that in a sterilization phase, sterilization medium flows through said sterilization tube and treats an interior of said container, wherein a lower end portion of said give length of said sterilization tube is provided with an opening that during said sterilization phase is disposed so deeply within said container that said sterilization medium is also supplied to a base region of said container that is disposed opposite a mouth region thereof.

2. A filling element according to claim 1, wherein a means that surrounds said discharge opening and receives said mouth region of said container is provided, wherein a centering means for said container is provided, and wherein in said upper stroke position said lower end portion of said given length of said sterilization tube is disposed in the vicinity of at least one of the following: said discharge opening, said means that surrounds said discharge opening, and said centering means for said container.

3. A filling element according to claim 2, wherein said means that surrounds said discharge opening is an abutment or a sealing means.

4. A filling element according to claim 1, wherein said discharge opening is radially offset relative to an axis of said sterilization tube, and preferably concentrically surrounds said sterilization tube.

5. A filling element according to claim 4, which includes at least one gas channel for supplying and/or withdrawing said sterilization medium to or out of said container that has been placed against said filling element, with said at least one gas channel being open at said underside of said filling element and opening into an interior of said container that has been placed against said filling element.

6. A filling element according to claim 5, wherein said at least one gas channel is an annular channel that extends in an annular manner about said sterilization tube, with at least one of said discharge opening and said liquid channel in turn surrounding said annular channel in an annular manner.

7. A filling element according to claim 5, wherein said liquid flow valve is provided with a valve body that is movable by a prescribed stroke in the direction of said axis of said filling tube, said valve body having an opening and said sterilization tube being guided through said opening and being movable relative to said valve body.

8. A filling element according to claim 7, wherein an upper end of said valve body is provided with a valve stem-like extension, and wherein said sterilization tube is guided through said opening of said valve body and through an opening of said stem-like extension, and preferably in such a way that said at least one gas channel is formed between an outer surface of said sterilization tube and an inner surface of said opening of said valve body and said stem-like extension.

9. A filling element according to claim 5, wherein said sterilization tube forms an element of a valve body that in said upper stroke position closes off said gas channel.

10. A filling element according to claim 9, wherein said lower end portion of said sterilization tube forms a valve body that in said upper stroke position of said sterilization tube rest against a valve seat to thereby close off said gas channel.

11. A filling element according to claim 1, which includes a vacuum source and a vacuum connection for connecting said sterilization tube to said vacuum source, with said vacuum connection being provided with a second control device.

12. A filling element according to claim 1, wherein said control means is a piston/cylinder arrangement with at least one cylinder and one piston that is displaceable therein, with said piston defining within said cylinder at least one cylinder chamber to which, for a stroke movement of said sterilization tube, can be supplied a pressure medium, and wherein said sterilization tube projects downwardly beyond said piston.

13. A filling element according to claim 12, wherein for a movement of said sterilization tube into said lower stroke position, the pressure of sterilization medium can be supplied to said at least one cylinder chamber via control device means, preferably via said first control device.

14. A filling element according to claim 13, wherein said at least one cylinder chamber is part of said connecting means for connecting said source for a sterilization medium to said filling element.

15. A filling element according to claim 14, wherein said piston is provided with a channel that connects the interior of said sterilization tube with said at least one cylinder chamber.

16. A filling element according to claim 12, wherein a respective cylinder chamber is formed on opposite sides of said piston, with each of said cylinder chambers being adapted to receive a pressure medium, with at least one of said cylinder chambers, for said stroke movement of said sterilization tube, being controllable by at least one pressure medium control valve, preferably the compressed air control valve.

17. A filling element according to claim 16, wherein at least a lower one of said cylinder chambers that faces said underside of said filling element and effects movement of said sterilization tube into said upper stroke position, is controllable via said pressure medium control valve.

18. A filling element according to claim 12, wherein said piston/cylinder arrangement is as a pneumatic spring.

19. A filling element according to claim 12, wherein said piston is provided with a channel that communicates with said sterilization tube and, in at least one stroke position of said piston and said sterilization tube, also communicates with a channel that is formed at least partially in said cylinder.

20. A filling element according to claim 19, wherein said channel in said piston opens out on a peripheral surface of said piston and in said at least one stroke position is aligned with an opening of said channel that is formed at least partially in said cylinder.

21. A filling element according to claim 1, wherein said control means as well as said first control device for said connecting means for connecting said source for a sterilization medium to said filling element, are controllable such that already upon movement of said sterilization tube out of said upper stroke position and into said lower stroke position, said sterilization medium is discharged from said sterilization tube.

22. A filling element according to claim 1, wherein said control means is controlled in such a way that during said filling phase, with said liquid flow valve open, and preferably also during a pressurizing phase that precedes said filling phase, said sterilization tube is disposed in said upper stroke position.

23. A filling element according to claim 1, wherein to determine the volume of said filling material that is flowing to a respective container during said filling phase, at least one flowmeter is provided in one of said liquid channel and a liquid material connection that leads to said liquid channel.

24. A filling element according to claim 1, wherein in said lower stroke position of said sterilization tube, said lower end portion of said sterilization tube is disposed immediately adjacent said base portion of said container.

* * * * *

UNITED STATES PATENT AND TRADEMARK OFFICE

CERTIFICATE OF CORRECTION

PATENT NO. : 5,564,481

DATED : Oct. 15, 1996

INVENTOR(S) : Clüsserath

It is certified that error appears in the above-indentified patent and that said Letters Patent is hereby corrected as shown below:

On the title page;please change item [73] Assignee to read --

KHS Maschinen- und Anlagenbau Aktiengesellschaft, Bad Kreuznach, Germany --.

Signed and Sealed this

Twenty-first Day of January, 1997

*Attest:*

*Attesting Officer*

BRUCE LEHMAN

*Commissioner of Patents and Trademarks*